US006402002B1

(12) United States Patent
Benton

(10) Patent No.: US 6,402,002 B1
(45) Date of Patent: Jun. 11, 2002

(54) TOOL CADDY CARRIER AND TOOL ORGANIZER

(76) Inventor: Patrick Hart Benton, 2350 S. Presado Dr. Unit D, Diamond Bar, CA (US) 91765

( * ) Notice: Subject to any disclaimer, the term of this patent is extended or adjusted under 35 U.S.C. 154(b) by 0 days.

(21) Appl. No.: 09/602,377

(22) Filed: Jun. 22, 2000

(51) Int. Cl.[7] ..... A45F 3/02

(52) U.S. Cl. ..... 224/600; 224/674; 224/677; 224/904

(58) Field of Search ..... 224/600, 904, 224/674, 677; 206/373, 372, 374, 375; 211/70.6

(56) References Cited

U.S. PATENT DOCUMENTS

| | | | | | |
|---|---|---|---|---|---|
| 4,416,372 | A | * | 11/1983 | Polk | 206/372 |
| 4,667,822 | A | * | 5/1987 | Coopmans | 206/373 |
| 4,953,764 | A | * | 9/1990 | Kovacs | 224/904 X |
| D316,485 | S | * | 4/1991 | Seber | D3/105 |
| D329,135 | S | * | 9/1992 | Embree | D3/30.1 |
| D333,040 | S | * | 2/1993 | Dancyger | D3/105 |
| D345,237 | S | * | 3/1994 | Stein | D32/53 |
| 5,337,933 | A | * | 8/1994 | Nunez | 224/904 X |
| 5,551,615 | A | * | 9/1996 | McIntosh | 224/600 X |
| 5,626,272 | A | * | 5/1997 | Klemansky | 224/904 X |
| D381,804 | S | * | 8/1997 | Dancyger | D3/224 |
| 5,813,530 | A | * | 9/1998 | Kornblatt | 206/373 |
| 6,179,185 | B1 | * | 1/2001 | Dancyger | 224/674 |

* cited by examiner

*Primary Examiner*—Gregory M. Vidovich
*Assistant Examiner*—Maerena W. Brevard

(57) ABSTRACT

A tool caddy carrier with sturdy construction, lightweight, easily customized and transports easily. The carrier can be customized for use by any tradesman using belt type tool pouches, various decks for tool storage, and a storage tray. This carrier can rest on most flat surfaces in an upright position. The carrier can be carried by hand or with a shoulder strap. The shoulder strap can be used for carrying when hands must be free for such things as climbing ladders and carrying larger parts.

1 Claim, 6 Drawing Sheets

TOOL CADDY CARRIER AND TOOL ORGANIZER

BACKGROUND OF THE INVENTION

1. Field of the Invention

The present invention relates in general to tool carriers, in particular to a tool caddy carrier and organizer to be used by the service person. The present invention can be customized to meet the particular service person's needs.

2. Prior Art

Many service personnel; electricians, air conditioning repairmen and women, maintenance mechanics, and many technological fields of the workforce, have faced the problem of carrying many tools to complete a job. In the past, these tools have been carried in tool pouches, carried on a tool belt, carried in plastic trays and buckets, but none of the currently available carriers could be customized to the needs of the service person.

U.S. Pat. No. D329,135S tool caddy has carry handle, and tray on each side of handle for storage of tools.

U.S. Pat. No. D345,237 tool pouch for bucket, is a fabric tool carrier that fits inside a 5 gallon pail U.S. Pat. No. D381,804S belt type tool pouch can be used for tools or as nail bag.

U.S. Pat. No. D333,040S belt type tool pouch can be used for tools or other supplies.

U.S. Pat. No. D316,485 belt type nail and tool bag.

No device is known, however, that combines both existing belt type tool pouches, with a tool pouch carrier making it possible to customize the tool carrier to the service person's needs. This tool pouch carrier then becomes a self-standing workstation with easy access to all the tools you choose to include in your tool carrier. The tool caddy carrier can be carried to the job site by one's side using the fixed handle on the top of the carrier, or carried to the job site using a shoulder strap that can be attached to the tool carrier, when it is necessary. This frees up a person's hands for such things as climbing ladders.

SUMMARY OF THE INVENTION

The principal object of my present invention is to provide a device for use in carrying out my work in the most efficient manner as possible. I, Patrick H. Benton, have discovered the solution by combining a tool carrier with an existing belt type tool caddy that can be purchased on the market today. This combination tool caddy carrier device can be customized to one's personnel needs.

It is also an object of the present invention to provide a device, which is simple and with sturdy construction.

Another object is to provide a device that is lightweight and easy to transport to the job site. This device can be carried by a fixed handle or by optional shoulder strap when hands must be free, for such things as climbing a ladder.

A further object is to provide a device that when in use will decrease the chance of not having the proper tools when the worker gets to the job site.

The foregoing objects can be accomplished by providing a combination lightweight tool caddy carrier and tool organizer. This invention has a base tray rectangular in shape and will have an upright vertical support mounted 5 inches from the front of the base tray extending from side to side and extending 16 inches vertically from inside of the bottom of the base tray. Near the top of the upright support and adjustable in height is a removable support bar mounted horizontal and spaced out from the upright support. The above support bar is designed to hold a purchased belt type tool caddy in a horizontal position near the top of the upright support. There are many belt type tool caddies available on the market today. This device will have an insert in the base tray, between the back of the base tray and the upright. This insert will hold in upright position seven nut drives, sizes: 3/16", 1/4", 5/16", 11/32", 3/8", 7/16", and 1/2". This insert will also hold in upright position 5 drill bits and 5 thread taps. This invention also has a second insert mounted on the backside of the upright support, which will hold 4 screwdrivers and 2 larger tools, such as pliers. This invention has a carry handle built into the upright support. On each side of the upright support there is a receiver hole for the optional shoulder strap.

DETAILED DESCRIPTION

Figure 1:
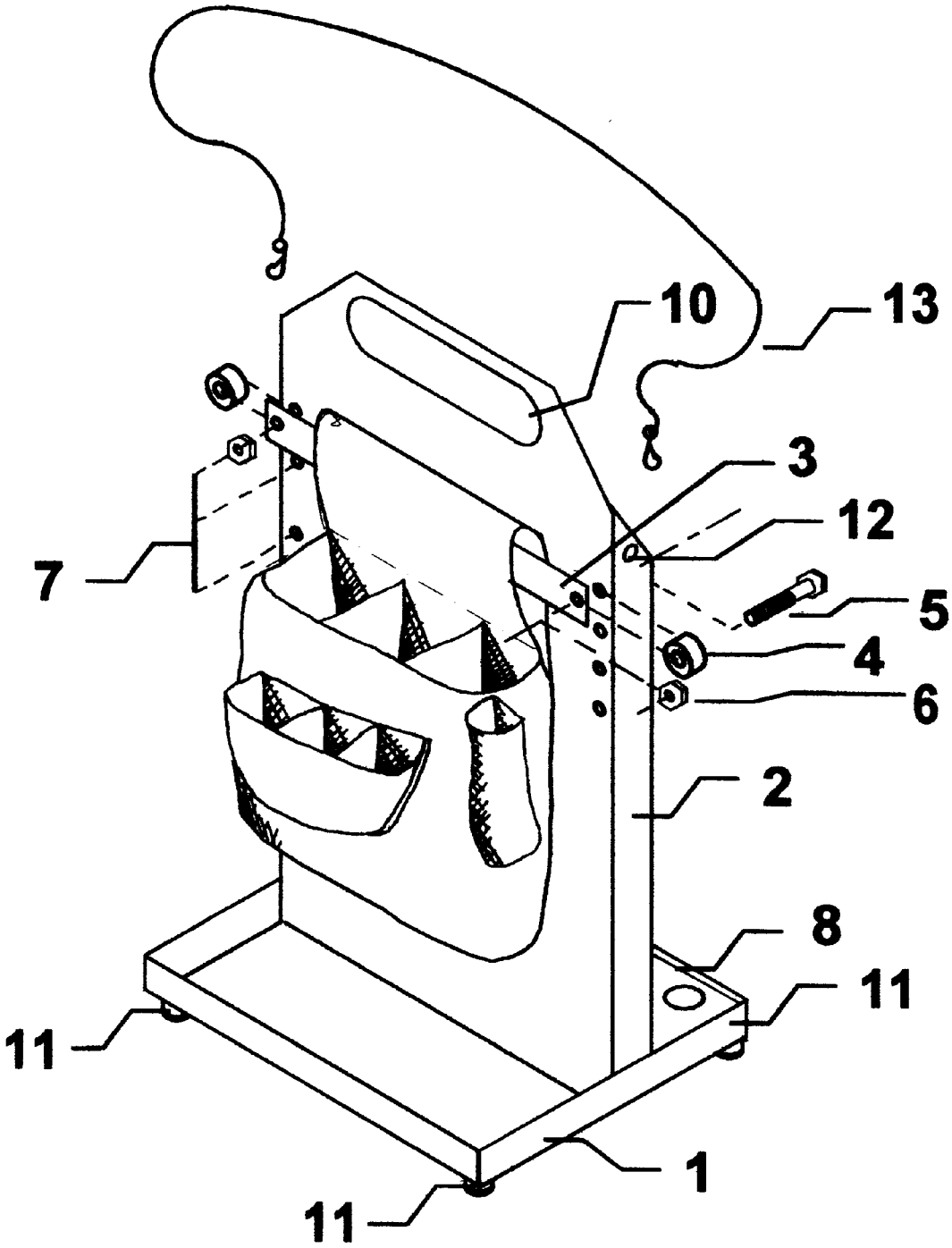
FIG. 1 is a perspective view of the first side of the tool caddy carrier and tool organizer with a belt type tool caddy (not part of present invention) shown on the tool caddy carrier.

With reference now to the FIGURES wherein like reference characters designate like or similar parts throughout the several views. FIG. 1 is a perspective view of the first side of the invention. The belt type tool caddy is not part of the present invention but is included to illustrate the use of support bar (3).

The base tray (1) should be about 8 inches deep by 10 inches wide with one inch wide sides to support the upright (2) that should be about 16 inches high and about 10 inches wide. The upright (2) also has one-inch sides with 3/4 inch return to provide support to the upright. The base tray and upright should preferably be made of a lightweight metal such as aluminum or strong molded plastic. The upright is attached to the tray about 5 inches from the front of the tray. This unit is the backbone of the present invention.

The base of the unit (1) will have rubber or plastic feet (11) on each corner of the bottom for stability when resting on any surface. The one-inch sides on the base form a tray, which can be used for storage of small parts.

A one-inch wide flat support bar (3), preferably made of aluminum or strong rigid plastic, will be referred to as the caddy carrier bar. The caddy carrier bar will be mounted to upright (2) using parts 4, 5, and 6. The fasteners (5) will be inserted through one of four sets of drilled holes (7) in the upright. Then, the fastener will pass through spacer (4) and caddy carrier bar (3) and be secured by nut (6). Spacer (4) is used to hold the caddy carrier bar about 1/2 inch away from the upright to allow for attachment of a belt type tool caddy as shown in the figure. There are four sets of drilled holes (7) placed one inch apart to allow the caddy bar to be adjustable.

The top of the upright contains cutout (10) to create a handle for carrying. A plastic or cushion grip will be attached to provide a secure and comfortable grip. Located on the sides at the top of each side of the upright are receiver holes (12) for attachment of a shoulder strap. The detachable shoulder strap (13) will be made of strong flexible material. It will be variable in length with a latching device on each end to be used to attach the shoulder strap to the carrier.

Figure 2:
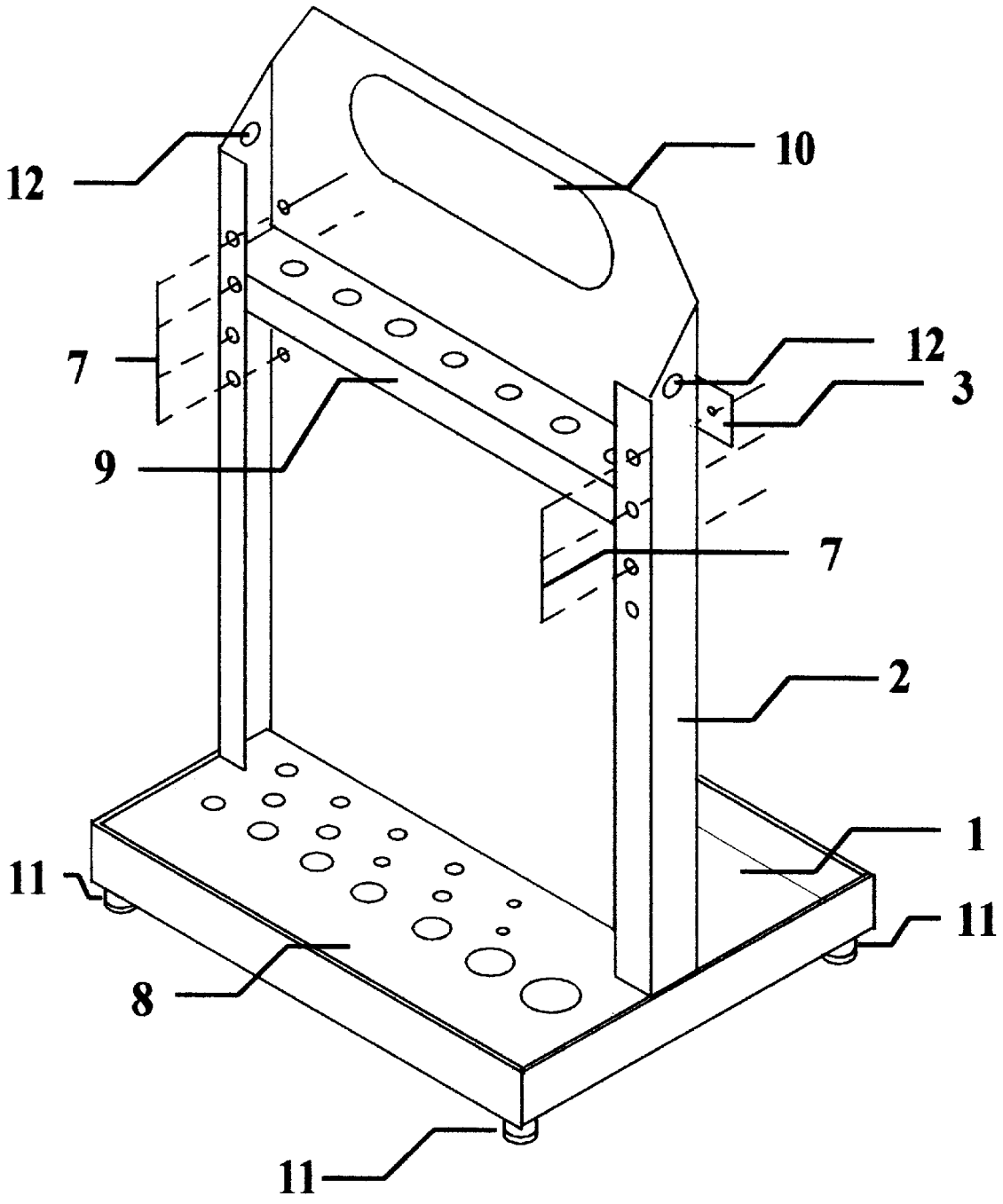
FIG. 2 is the perspective view of the second side of the present invention.

FIG. 2 is a perspective view of the second side of the present invention. This figure shows the one-inch sides of the upright. The sides then have a ¾ inch return. This U-shape provides for placement of the inserts (8,9). This view shows insert (8) located in the base tray (1) between the back of the base tray and upright (2). The insert (8) will preferably be made of wood or molded plastic. There will be seven holes of various size drilled through the insert to allow for the insertion of nut drivers, sizes 3⁄16", ¼", 5⁄16", 11⁄32", ⅜", 7⁄16", and ½". The nut drivers are not part of the present invention but are mentioned to show the use of insert (8). Insert (8) will also have holes drilled to hold up to 5 drill bits and 5 threaded tapes in an upright position.

Insert (9) is placed in the upright support at one of four heights using one of the four sets of holes (7). The insert can be attached at the same height as the caddy carrier bar (3) using the bars' fasteners or at a different height using separate fasteners. This insert is preferably made of wood or molded plastic. Seven holes have been drilled through the insert to be used to carry tools such as screwdrivers, pliers, or scissors.

Figure 3:
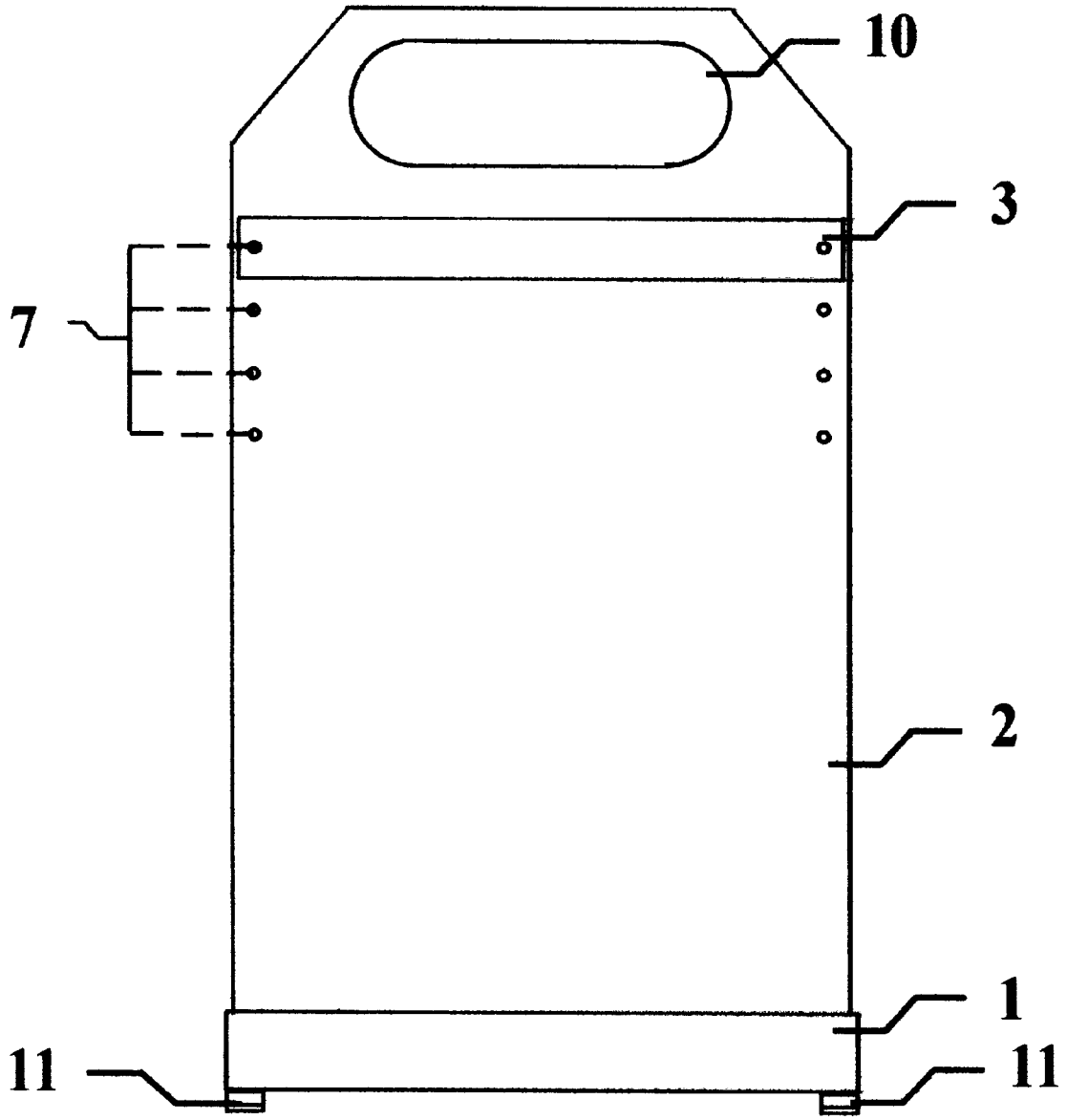
FIG. 3 is a front view of the tool caddy carrier showing the first side.
Figure 4:
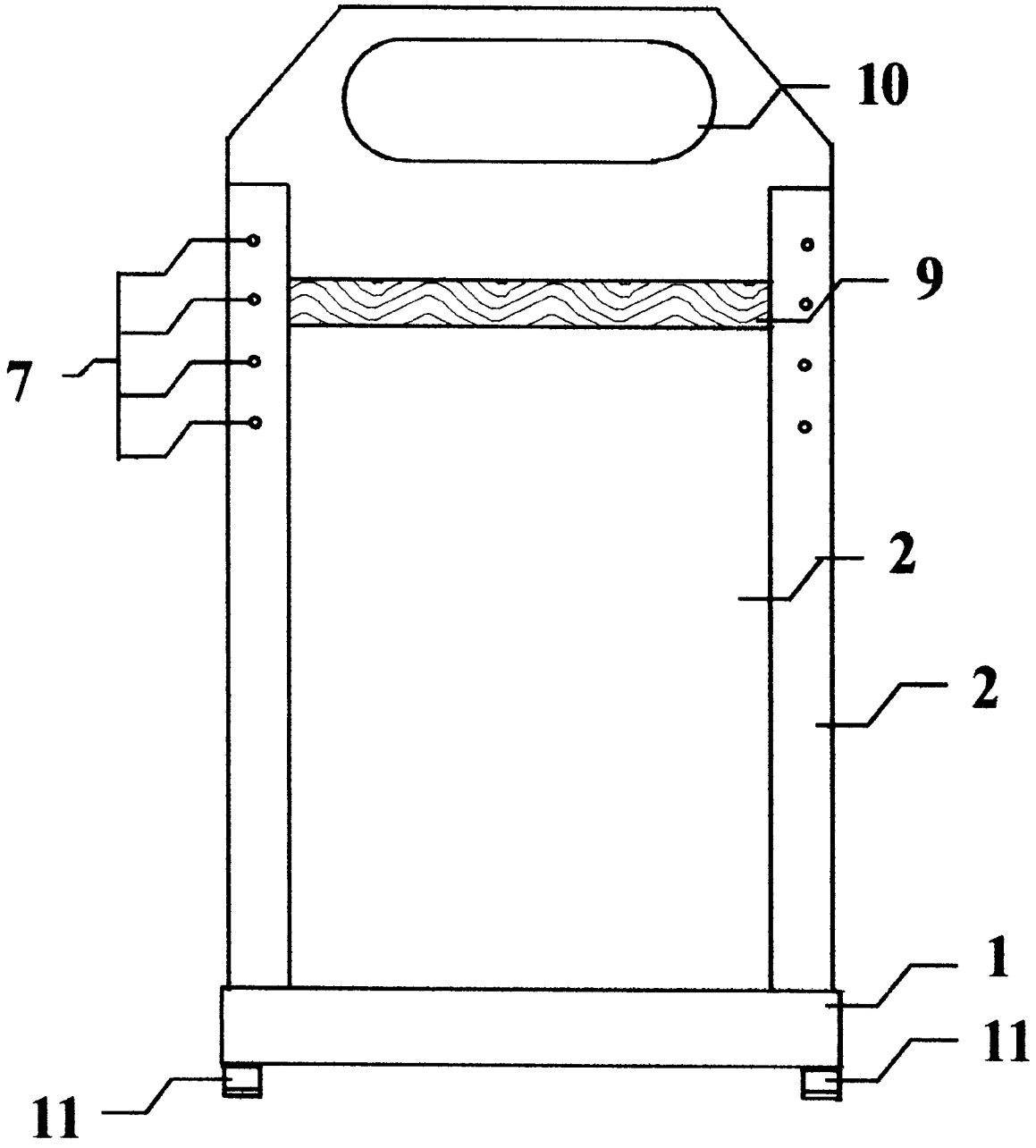
FIG. 4 is a rear view of the tool caddy carrier showing the second side.

FIG. 3 and FIG. 4 show the front and rear view of the present invention. The adaptability of the device is shown by the varying placement of caddy carrier bar (3) and insert (9).

Figure 5:
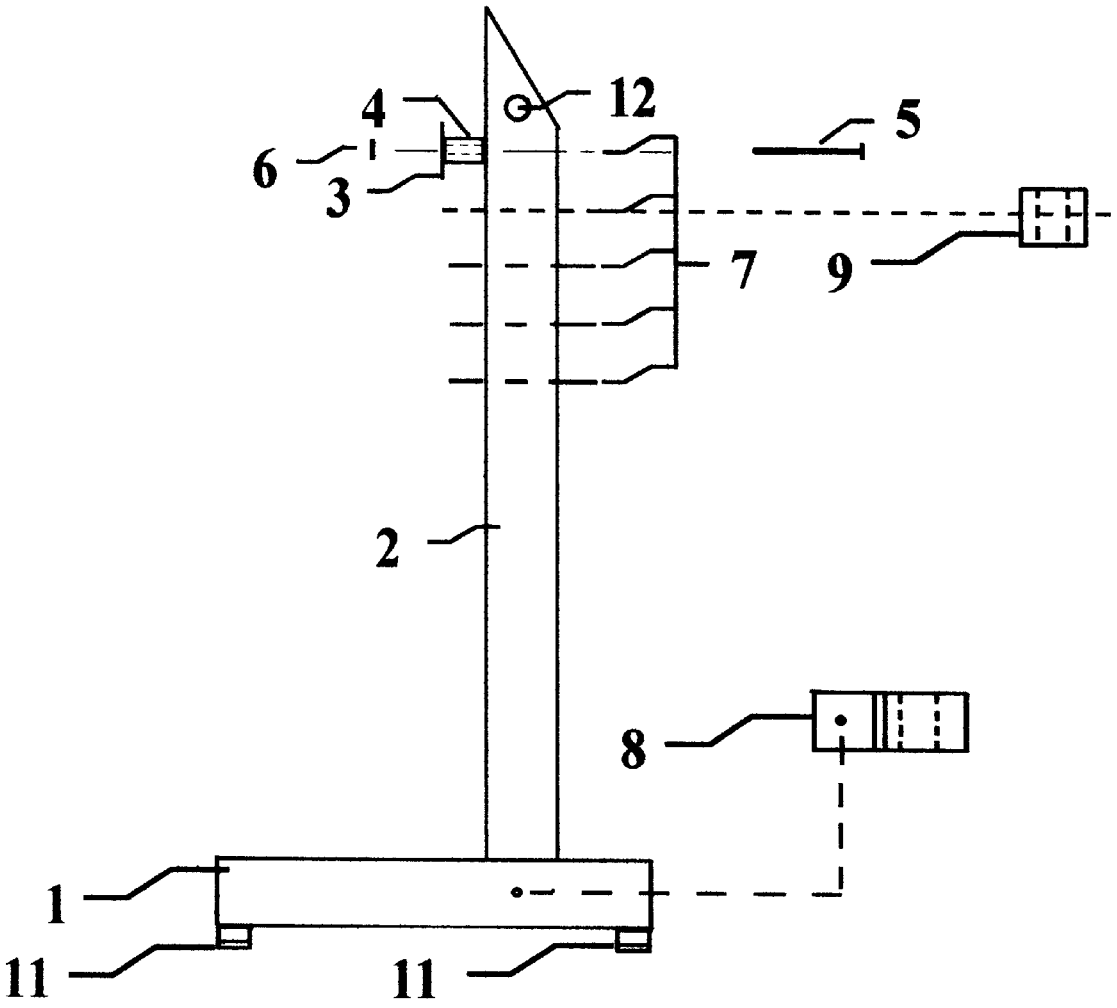
FIG. 5 is the side view of the tool caddy carrier showing inserts 8 and 9.

FIG. 5 shows the side view of the present invention. This figure further illustrates the gap created between upright (2) and caddy carrier bar (3). Also, shown from the side is the fastener device for the caddy carrier bar.

Figure 6:
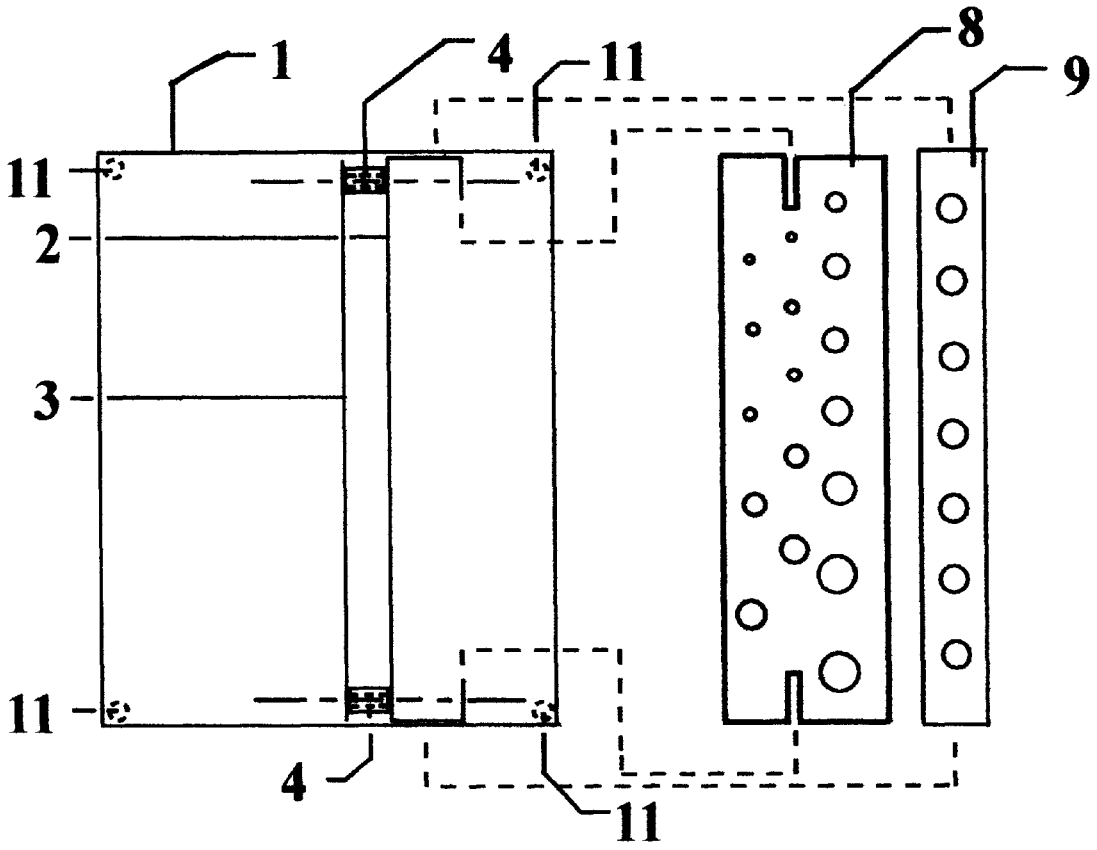
FIG. 6 is the top view of the tool caddy carrier showing inserts 8 and 9.

FIG. 6 shows the inserts (8,9) with the various holes created for carrying tools. This figure also shows the positioning of the inserts.

This device is suitable for all levels and types of workman, from the novice to the most experienced, from a carpenter to an electrician to a mechanic. Some highlights of this device are that it transports easily, takes up a small amount of space and can be customized to the type of work being done.

I found the theory behind this invention while working as a maintenance mechanic in a manufacturing plant. Many times I had to climb ladders or go to various locations in the plant to do different types of jobs that required many different tools. I needed to find a way to transport the tools needed for the particular task needing done. I conceived the idea of the tool caddy carrier and tool organizer to be more efficient on the job.

The foregoing description of the preferred embodiment of the invention has been presented for the purposes of illustration and description. It is not intended to be exhaustive or to limit the invention to the precise form disclosed. Many modifications and variations are possible in the light of the above teaching. It is not intended that the scope of this invention be limited not by this detailed description, but rather by the claim appended hereto.

I claim:

1. A lightweight tool caddy carrier able to be customized for a service person or technician comprising:

a horizontal base storage tray having vertical sides forming an area for small parts storage;

a first tool receiver attachable to the base having a plurality of drilled holes for vertical storage of tools;

a vertical upright having a output handle, a first side, and a second side, wherein the upright is permanently attached perpendicular to the storage tray, forming a basic unit;

a horizontal bar attachable to the first side of the upright at varying heights for attachment of a belt tool pouch;

a second tool receiver attachable to the second side of the upright, parallel to the storage tray, having a plurality of drilled holes for vertical storage of screwdrivers and other cylindrical tools; and a pair of receivers attached to the upright for attachment of a removable shoulder strap.

* * * * *